United States Patent [19]

Stahlecker

[11] 4,125,991

[45] Nov. 21, 1978

[54] MOBILE SERVICING DEVICE FOR AN OPEN END SPINNING FRAME

[75] Inventor: Fritz Stahlecker, Josef-Neidhart-Strasse 18, 7341 Bad Überkingen, Germany

[73] Assignees: Hans Stahlecker; Fritz Stahlecker, both of Germany

[21] Appl. No.: 806,524

[22] Filed: Jun. 14, 1977

Related U.S. Application Data

[63] Continuation-in-part of Ser. No. 798,380, May 19, 1977.

[30] Foreign Application Priority Data

Jun. 29, 1976 [DE] Fed. Rep. of Germany ..... 2629161

[51] Int. Cl.[2] ..... D01H 11/00

[52] U.S. Cl. ..... 57/302; 15/304; 57/304

[58] Field of Search ..... 57/56, 58.89; 15/301, 15/304

[56] References Cited

U.S. PATENT DOCUMENTS

| | | | |
|---|---|---|---|
| 3,524,312 | 8/1970 | Landwehrkamp et al. | 57/56 |
| 3,597,911 | 8/1971 | Schiltknecht | 57/56 |
| 3,662,532 | 5/1972 | Stahlecker | 57/58.89 |
| 3,869,851 | 3/1975 | Muller | 57/56 X |
| 4,028,136 | 6/1977 | Kamp | 57/56 X |

*Primary Examiner*—Christopher K. Moore
*Attorney, Agent, or Firm*—Craig & Antonelli

[57] ABSTRACT

A mobile servicing device is provided for servicing spinning assemblies of an open-end spinning machine. The servicing device includes several cleaning elements carried on a drive member which is rotatably driven by a drive motor. The cleaning elements are selectively movable into and out of a penetrating position in a spinning rotor. The cleaning elements are connected to the drive member by way of spring members which accommodate radial movement of the cleaning elements during cleaning operations. In preferred embodiments, the cleaning elements are supported on leaf springs which permit movement of the cleaning elements in the radial direction in response to centrifugal forces during rotation of the drive member. Preferred embodiments also include vacuum means as well as cleaning nozzles, with the cleaning nozzles being carried by the rotatable drive member.

27 Claims, 10 Drawing Figures

MOBILE SERVICING DEVICE FOR AN OPEN END SPINNING FRAME

BACKGROUND AND SUMMARY OF THE INVENTION

This application is a continuation-in-part application of my copending application Ser. No. 798,380, filed May 19, 1977, for my invention titled "MOBILE CLEANING DEVICE FOR AN OPEN-END SPINNING MACHINE".

The invention relates to a servicing device which can travel along at least one spinning frame of the type having a plurality of spinning assemblies. The servicing device of the type contemplated has means for opening a spinning assembly and means for presenting a cleaning device into an open-sided spinning rotor which is made accessible by the opening of a spinning assembly. The cleaning device contemplated by this invention has at least one cleaning element that penetrates into the spinning rotor, said element being furnished with a drive for execution of cleaning motions. See my above-noted copending application (corresponding to German Application No. P 26 22 627.7) for a further description of the type of cleaning device with which the invention is concerned.

By the proposal of my above-identified copending application, the possibility is offered that a stopped spinning rotor of an open end spinning assembly may also be cleaned. Here preferably there is provision that a brush with its bristles will be moved along a yarn collecting groove of the spinning rotor, i.e. in a radial plane with reference to the rotor axis.

The invention is addressed to the problem of producing, as a further development of the invention of my above-identified application, a simply constructed and economically manufactured cleaning device. The invention contemplates providing that the cleaning element or elements are connected with their drive via spring elements which are radially adjustable with reference to the rotor axis during the cleaning operations.

By this arrangement there is the advantage that the cleaning elements can be pressed with sufficient force against the inner walls of the rotor and especially against the yarn collecting groove, without danger of damage to the rotor. The adjustability of the cleaning elements, radially with reference to the rotor axis, further allows introduction of these cleaning elements into rotors which have different dimensions, to effect cleaning operations. This case may arise if the servicing device is intended for several spinning frames which in some situations may be processing different materials, or producing another yarn, and for this reason are equipped with rotors of different sizes.

In a first embodiment of the invention, it is provided that a controlled setting device, advantageously electric, is connected with the spring member/members, effecting a motion that is directed radially, with reference to the motor axis. This setting device is actuated when the motion of presenting the cleaning device to the spinning rotor that is to be cleaned has been completed.

In another advantageous embodiment of the invention there is a rotary drive on which the cleaning element/elements are held by spring members that are radially yielding with reference to the axis of rotation when the rotary drive is switched on, because of centrifugal forces, whereby the axis of rotation of the rotary drive during the cleaning operation is approximately coaxial to the rotor axis. This arrangement leads to particularly simple forms of embodiment where there is no need for setting members or the like that would have to be controlled or actuated in addition to the rotary drive. It is further advantageously provided that the rotary drive is equipped with a device that regulates the rotational speed. Thereby it is possible with this embodiment to select the strength of the application force with which the cleaning elements are to be applied to the spinning rotor and especially to its yarn collecting groove. In addition, by regulation of the rotational speed, the whole deflection and force of application of the cleaning elements can be adapted to various rotor diameters, with provision of higher rotational speeds for larger rotors.

In a further embodiment of the invention, it is provided that the cleaning device will have a plurality of different kinds of cleaning elements. By simultaneous use of different kinds of cleaning elements, there can be an especially thorough yet protective cleaning of the spinning rotor in a short time.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
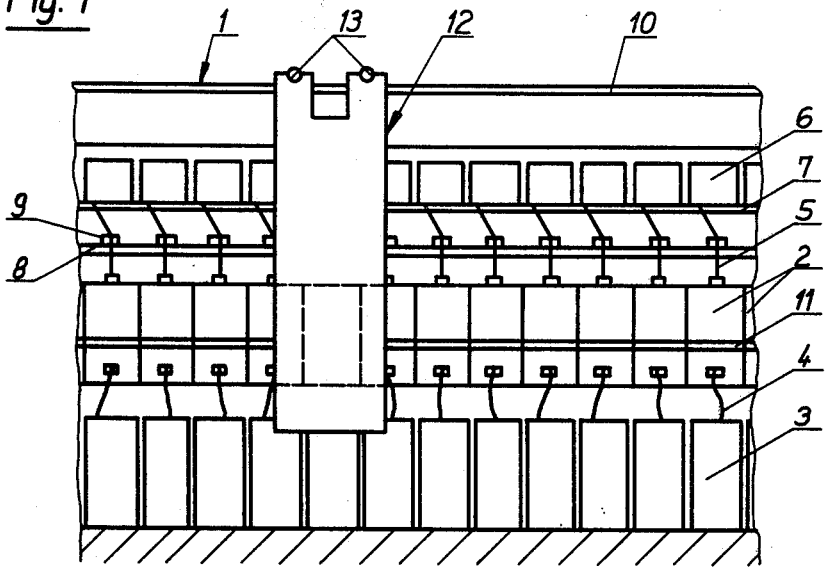
FIG. 1 is a partial sectional schematic front view of an open end spinning frame with a travelling servicing device constructed in accordance with the present invention.

The illustrated open end spinning frame 1 of FIG. 1 has a plurality of spinning assemblies 2 disposed side by side. A sliver 4 is delivered from a cam 3 to each spinning assembly 2 to be spun in a known way in spinning assembly 2, and taken off as yarn 5. The spun yarn 5 is wound on a winding bobbin 6 driven by a friction roll 7. The takeoff of yarn 5 is effected by means of takeoff rolls 8 and 9. In order not to obscure the present invention, many details of the spinning assemblies and the servicing device are omitted in the drawings and this description. However, such details can be readily constructed by those skilled in the art of open-end spinning machines, given this disclosure and the state of the art.

There are rails 10, 11 arranged along open end spinning frame 1, on which a servicing device 12 travels, with wheels 13 whereof in FIG. 1 only the upper ones are visible. The servicing device 12 contains a cleaning device for spinning rotors. Device 12 can be made as an independently travelling cleaning device, or as an instrument which in addition to other devices for the execution of other servicing operations includes a cleaning device with appurtenant presenting and driving means.

Figure 2:
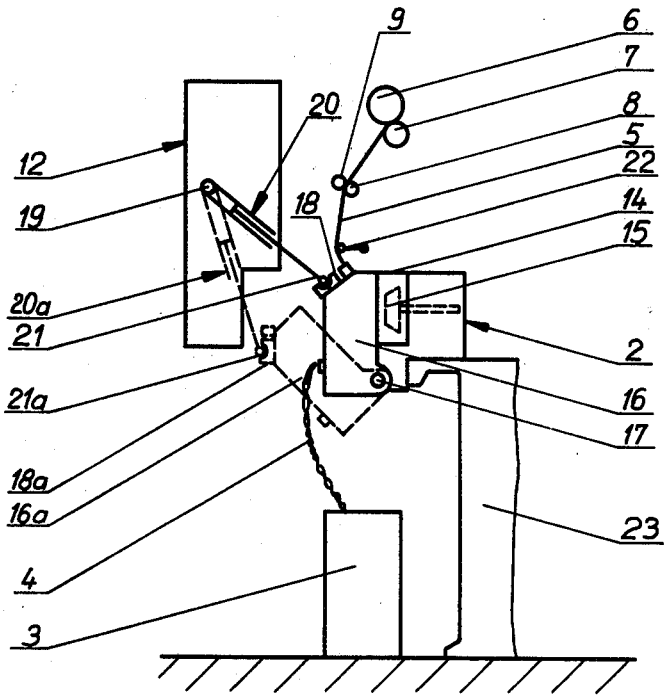
FIG. 2 is a partial cross sectional schematic view through the open end spinning frame of FIG. 1 with a schematic representation of the servicing device.

In FIG. 2 a servicing device 12 is shown in a servicing position at a spinning assembly 2. In the illustrated example, spinning assembly 2 comprises a stationary housing 14 fixed on the machine frame 23, and a fast-running spinning rotor 15. In front of stationary housing 14 there is a housing 16 or a cover that is swingable about a stationary shaft 17, whereby after the swinging down and opening, spinning rotor 15 is exposed. Cover **16*t* can include a delivery and opening device for sliver 4. The partly pivoted cover is shown at 16*a*, with dashed lines, in FIG. 2. The travelling servicing device 12 is equipped with means 20 for opening spinning assembly 2, comprising a piston-cylinder unit swingable about a shaft 19 engaging with a ball 21 in a suitable guide 18 on cover 16 of spinning assembly 2. After opening, the means 20 assume position 20*a* (dashed lines in FIG. 2) in which ball 21 is in position 21*a*, ball guide 18 is in position 18*a* and therewith cover 16 are held in folded up position 16*a***.

Figure 3:
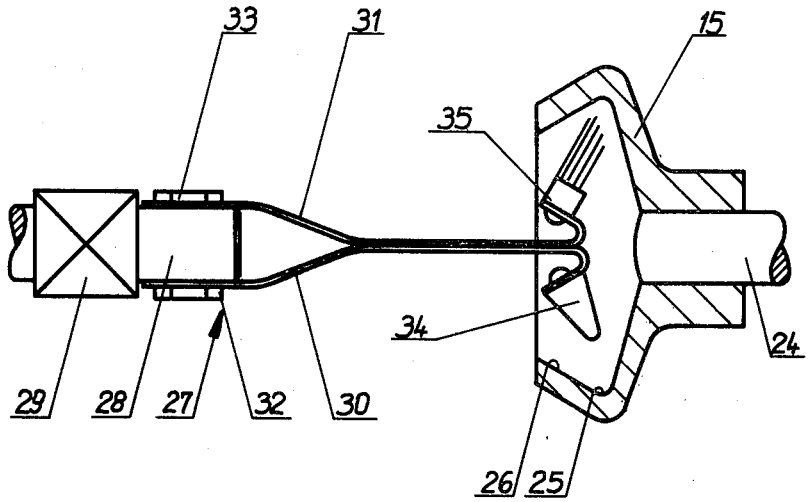
FIG. 3 is an enlarged partial sectional schematic view which shows a detail of the travelling servicing device of FIG. 1 inserted into a spinning rotor.

In FIG. 3 cover 16 and the other parts of the spinning assembly up to spinning rotor 15, as well as means 20 for opening the spinning assembly are not shown in order not to obscure the details of the invention. Only cleaning device 27 is shown, which is introduced straight into spinning rotor 15. Presenting of device 27 into rotor 15 is preferably effected by a hydraulic or pneumatic setting cylinder coaxial to spinning rotor 15, or by a swing drive whose swing axis is such that the rotor axis runs about tangentially to the curve defined around the swing axis during the cleaning. Spinning rotor 15 whose shaft 24 is borne in a way that is not illustrated, presents an open forward side, and has an annular yarn collecting groove 25. In groove 25 residues remain after interruption of a spinning process, and there must be removed from spinning rotor 15. Also, after a specific operating time other impurities have to be removed, which have become struck there. This cleaning process should be done also when spinning rotor 15 is stopped.

Figure 4:
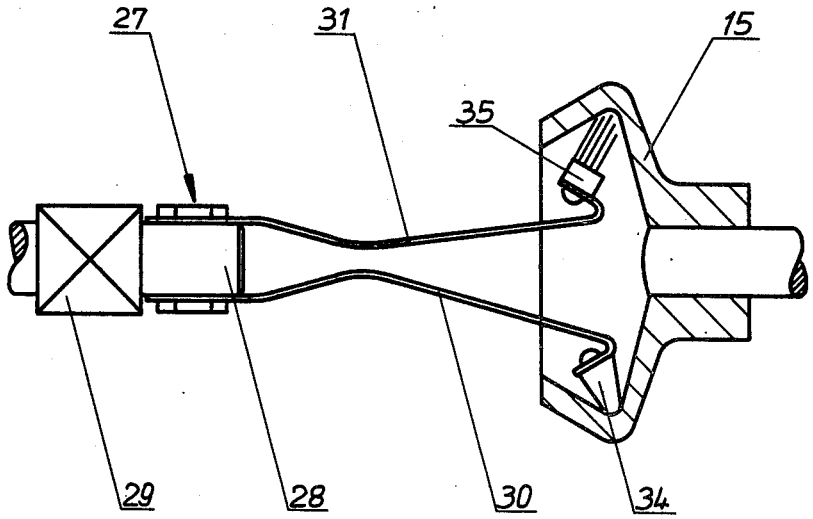
FIG. 4 shows the detail of FIG. 3 during a cleaning operation.

Cleaning device 27 disposed on the travelling servicing device 12 has two cleaning elements, a cleaning scraper 34 and a cleaning brush 35, disposed on leaf springlike spring members 30 and 31 respectively, which are fixed by their ends, via fastening means 32, 33, to a shaft 28 which can be driven in rotation by means of a motor 29. To facilitate the introduction of cleaning device 27 into spinning rotor 15, the spring members 30 and 31 are so made that scraper 34 and cleaning brush 35 can reach in the open side of spinning rotor 15 without contact. If now, as shown in FIG. 4, shaft 28 of cleaning device 27 is driven in rotation, then spring elements 30, 31 will bend outward because of centrifugal force, so that both scraper 34 and cleaning brush 35 will be applied against the yarn collecting groove 25 of spinning rotor 15 and clean it. Since there is a relative motion between cleaning device 27 and spinning rotor 15 for cleaning the rotor, spinning rotor 15 can be stopped in this method of cleaning. After completion of the cleaning, shaft 28 is stopped whereupon spring members 30, 31 again take the form indicated in FIG. 3, whereby cleaning device 27 can be withdrawn from spinning rotor 15. The cleaning elements are applied to spinning rotor 15 in the region of its yarn collecting groove with an elastic force that is a function of the spring stiffness of spring members 30, 31 and the rotational speed of motor 29. This force can be varied as required by adjustment of the motor velocity for which an electric control switch or variable gear can be associated with electric motor 29. It can then advantageously be provided that for example in entering the region of a spinning frame there will be automatic testing to determine if the rotational speed setting corresponds to the rotor size in question, and if there is a difference, switching over can be managed. For this, fingers are preferably disposed on the spinning frame, coordinated with sensors on the passing servicing device 12.

Figure 5:
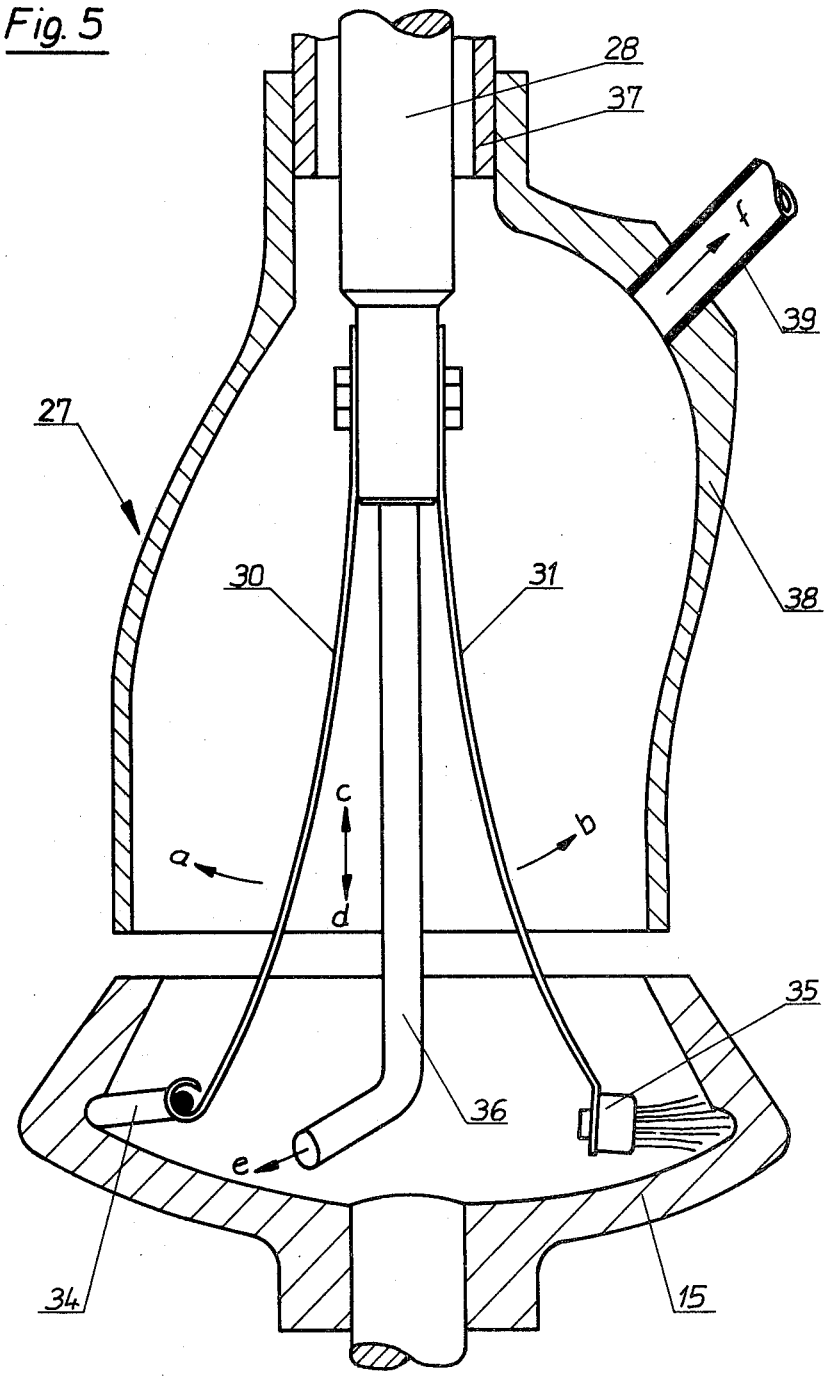
FIG. 5 is an enlarged partial sectional schematic view of a cleaning device that has a plurality of cooperating, simultaneously functioning cleaning elements according to another embodiment of the invention.
Figure 6:
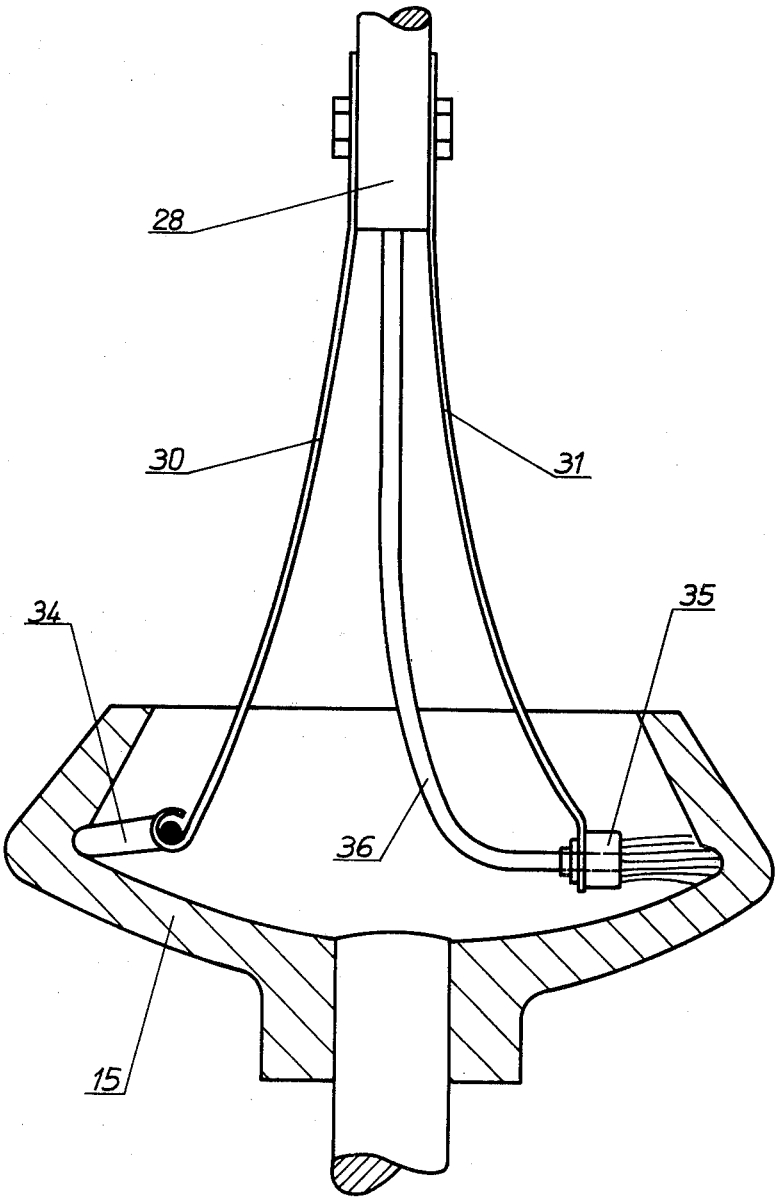
FIG. 6 is a partial sectional view similar to that of FIG. 5 showing another embodiment of the invention.

FIG. 5 shows an embodiment similar to that of FIGS. 3 and 4, where the direction of movement of spring elements 30 and 31 respectively under the effect of centrifugal force is indicated by arrows a and b. In addition to the previously described embodiment, there is a compressed air nozzle 36, which likewise rotates with shaft 28 and is associated with cleaning device 27 in the direction of double arrow c and d. Arrow e indicates the issuing of compressed air. This compressed air reinforces the mechanical cleaning action of scraper 34 and brush 35 and effects vigorous detaching of dirt particles in spinning rotor 15. Instead of compressed air, other embodiments are contemplated which bring in a cleaning liquid through jet 36. Moreover, in the embodiment as in FIG. 5 there is a bell-like cover 38 which covers the open side of spinning rotor 15 during the cleaning. Cover 38 is connected via a suction conduit 39 to a vacuum source that is not illustrated. The direction of movement of the suction air is indicated with arrow f. In this way the loosened dirt can go directly from rotor 15 into travelling device 12 or to another dirt collecting compartment. The embodiment according to FIG. 6 corresponds essentially to that of FIG. 5, with the difference, that nozzle 36 is disposed on the spring member 31 of cleaning brush 35.

Figure 7:
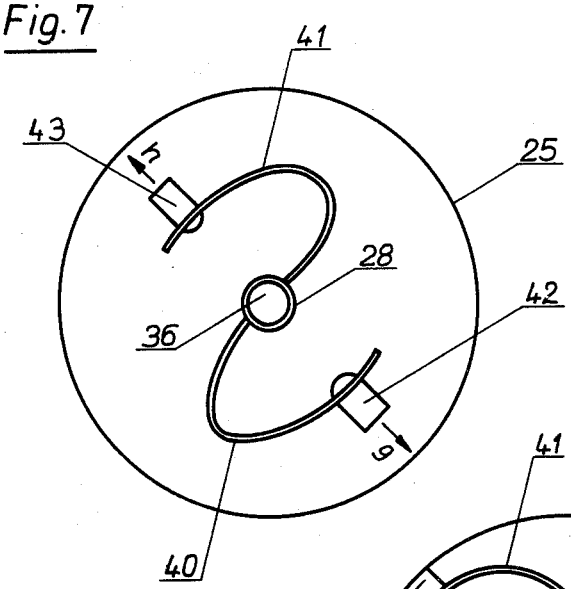
FIGS. 7 to 9 are front views of cleaning devices with spiral spring members for the cleaning elements constructed in accordance with other preferred embodiments of the present invention.
Figure 8:
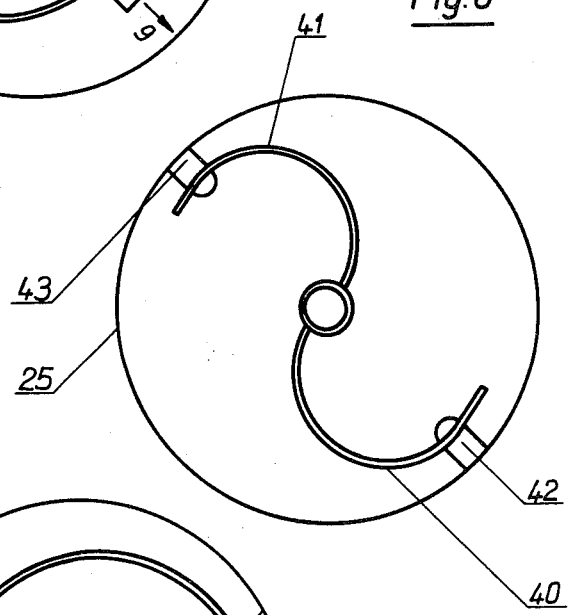

In FIG. 7 and 8 there is another embodiment of spring members 40 and 41 respectively, shown in FIG. 7 during introducton of cleaning device 27, and shown in FIG. 8 during the cleaning operation. Spring members 40,41 are similar to segments of helicoidal springs, and bear scrapers 42, 43 at their ends. Arrows g and h respectively indicate the direction of motion of scrapers 42, 43 when they are acted on by centrifugal force. A nozzle 36 for compressed air is provided inside shaft 28. Other preferred embodiments are contemplated wherein one or both of the scrapers 42, 43 are replaced with brushes.

Figure 9:
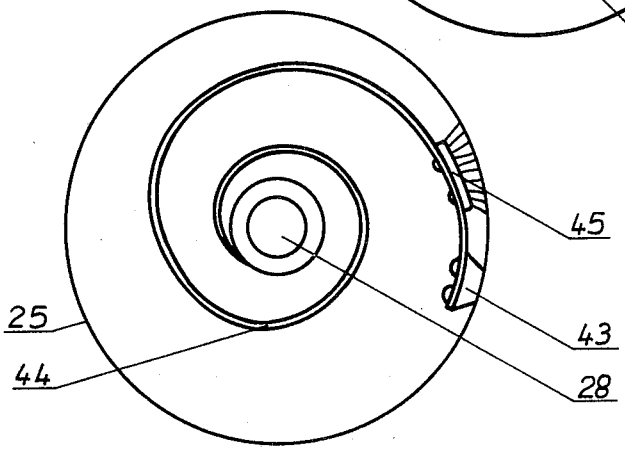

FIG. 9 shows another embodiment with only one helicoidal spring 44 that accepts both a scraper 43 and a cleaning brush 45 which run one behind the other along the collecting groove 25. In this case also, the cleaning brush 45 and scraper 43 are applied by centrifugal force when shaft 28 is driven. Instead of a cleaning brush or the like embodiments are also contemplated with a stringlike cleaning element that is pulled along the yarn collecting groove during the cleaning. In most cases it is advantageous to use a combination of action of various types of cleaning elements according to the invention.

Figure 10:
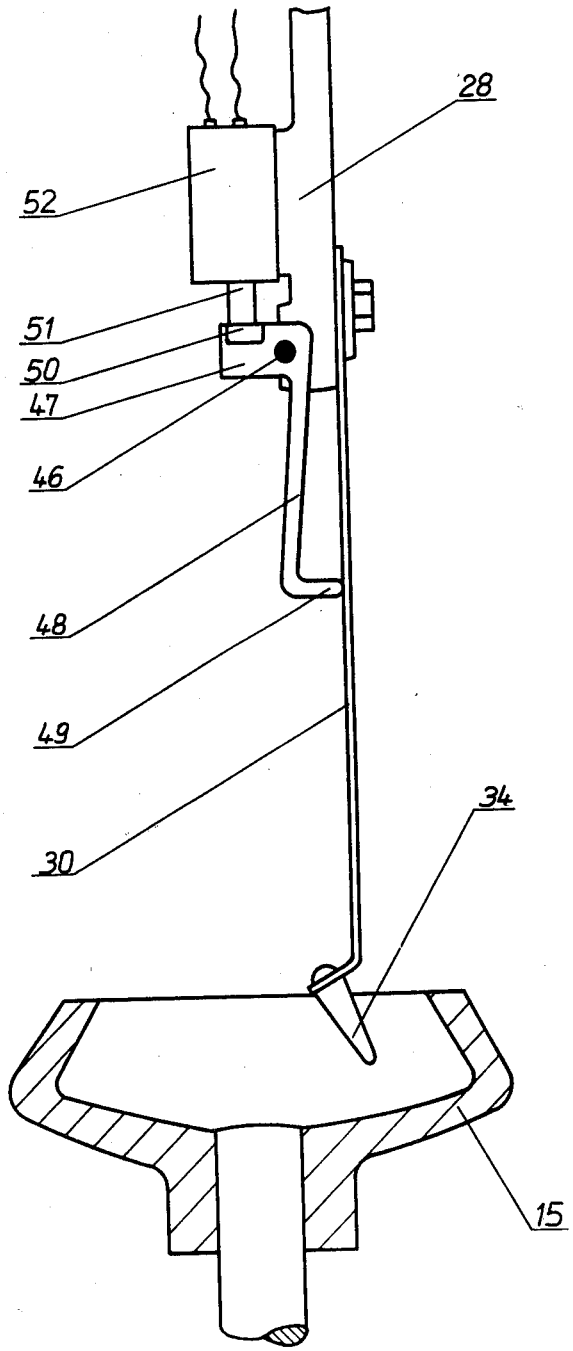
FIG. 10 is a view similar to FIG. 3, showing details of another embodiment of a travelling servicing device according to the invention.

In the embodiment according to FIG. 10 a spring member 30 for a scraper 34 is shown, which is applied to the yarn collecting groove of spinning rotor 15 not by centrifugal force, or not by centrifugal force alone. A setting device is provided which essentially comprises a double lever 47, 48 which is swingable about shaft 46, said double lever presenting a shoulder 49 that can be applied against spring member 30. A lifting piston magnet 52 is also disposed on shaft 28, whose piston 51 can press against an advantageously exchangeable actuating plate 50 for double lever 47, 48. The exchangeable plate 50 may present selectively different measurements corresponding to the desired elastic deflection of the leaf spring-like unilaterally held spring member 30, for example to produce an adaptation to spinning rotors with different dimensions and/or to different cleaning actions.

While I have shown and described various embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Cleaning apparatus for cleaning spinning rotors of open end spinning assemblies comprising:

at least one cleaning element means for cleaning a spinning rotor, drive means for drivingly moving said cleaning elements means to excecute rotor cleaning motions, spring member means interconnecting said cleaning element means and said drive means while permitting adjusting movement of said cleaning element means in a direction radial to the rotor rotational axis of a spinning rotor being cleaned, and an electrically controlled setting device for effecting radial adjustment of said spring member means with respect to said rotor rotational axis.

2. Apparatus according to claim 1, wherein a bell-like cover is provided which covers the open side of a spinning rotor during cleaning operations, said drive means and cleaning elements being disposed at least in part, in said bell-like cover, and wherein suction means are connected to said bell-like cover.

3. Cleaning apparatus for cleaning spinning rotors of open end spinning assemblies comprising:

at least one cleaning element means for cleaning a spinning rotor, drive means for drivingly moving said cleaning element means to execute rotor cleaning motions, spring member means interconnecting said cleaning element means and said drive means while permitting adjusting movement of said cleaning element means in a direction radial to the rotor rotational axis of a spinning rotor being cleaned, and wherein said cleaning element means, said drive means, and said spring member means, are all supported on a mobile servicing device which includes means for opening said spinning assemblies and stopping said rotors.

4. Apparatus according to claim 3, wherein said drive means includes a rotory drive for rotatably driving a drive member about an axis coaxial with said rotor rotational axis.

5. Apparatus according to claim 4, wherein said spring member means includes a portion attached to said drive member and another portion attached to said cleaning element means such that said cleaning element means are moved radially outwardly of said drive member by centrifugal force against the force of said spring member means during cleaning operations.

6. Apparatus according to claim 5, wherein said rotary drive includes means for regulating the rotational speed of said drive member.

7. Apparatus according to claim 6, wherein said cleaning element means includes a plurality of separate cleaning elements.

8. Apparatus according to claim 7, wherein said cleaning elements are disposed in a common plane extending radially of said rotor rotational axis during cleaning operations.

9. Apparatus according to claim 7, wherein said cleaning elements include at least one scraper and at least one brush.

10. Apparatus according to claim 9, wherein the spring member means includes unilaterally held spiral springs disposed in a plane extending radially to the rotational axis of the rotary drive, and wherein the cleaning elements are disposed on said unilaterally held spiral springs.

11. Apparatus according to claim 7, wherein said at least one cleaning element means includes a nozzle and means for supplying a cleaning medium under pressure to said nozzle, and wherein said nozzle is attached to said drive means to be movably driven to execute rotor cleaning motions.

12. Apparatus according to claim 7, wherein a bell-like cover is provided which covers the open side of a spinning rotor during cleaning operations, said drive means and cleaning elements being disposed, at least in part, in said bell-like cover, and wherein suction means are connected by said bell-like cover.

13. Apparatus according to claim 5, wherein said cleaning element means includes a plurality of separate cleaning elements.

14. Apparatus according to claim 5, wherein said at least one cleaning element means includes a nozzle and means for supplying a cleaning medium under pressure to said nozzle, and wherein said nozzle is attached to said drive means to be movably driven to execute rotor cleaning motions.

15. Apparatus according to claim 5, wherein a bell-like cover is provided which covers the open side of a spinning rotor during cleaning operations, said drive means and cleaning elements being disposed, at least in part, in said bell-like cover, and wherein suction means are connected to said bell-like cover.

16. Apparatus according to claim 4, wherein said rotary drive includes means for regulating the rotational speed of said drive member.

17. Apparatus according to claim 4, wherein a bell-like cover is provided which covers the open side of a spinning rotor during cleaning operations, said drive means and cleaning elements being disposed, at least in part, in said bell-like cover, and wherein suction means are connected to said bell-like cover.

18. Apparatus according to claim 4, wherein the spring member means includes unilaterally held spiral springs disposed in a plane extending radially to the rotational axis of the rotary drive, and wherein the cleaning elements are disposed on said unilaterally held spiral springs.

19. Apparatus according to claim 3, wherein said cleaning element means includes a plurality of separate cleaning elements.

20. Apparatus according to claim 19, wherein said cleaning elements are disposed in a common plane extending radially of said rotor rotational axis during cleaning operations.

21. Apparatus according to claim 19, wherein said cleaning elements include at least one scraper and at least one brush.

22. Apparatus according to claim 3, wherein said at least one cleaning element includes a nozzle and means for supplying a cleaning medium under pressure to said nozzle, and wherein said nozzle is attached to said drive means to be movably driven to execute rotor cleaning motions.

23. Apparatus according to claim 22, wherein a bell-like cover is provided which covers the open side of a spinning rotor during cleaning operations, said drive means and cleaning elements being disposed, at least in part, in said bell-like cover, and wherein suction means are connected to said bell-like cover.

24. Apparatus according to claim 3, wherein said spring member means include leaf spring like spring members which are connected at one portion thereof to the drive means and which extend in an axial direction with reference to the rotor rotational axis during cleaning operations, and wherein the cleaning element means are disposed on said leaf spring like spring members.

25. Apparatus according to claim 3, wherein a bell-like cover is provided which covers the open side of a spinning rotor during cleaning operations, said drive means and cleaning elements being disposed, at least in part, in said bell-like cover, and wherein suction means are connected to said bell-like cover.

26. Apparatus according to claim 3, wherein the spring member means includes unilaterally held spiral springs disposed in a plane extending radially to the rotational axis of the rotary drive, and wherein the cleaning elements are disposed on said unilaterally held spiral springs.

27. Cleaning apparatus for cleaning spinning rotors of open end spinning assemblies comprising:

a least one cleaning element means for cleaning a spinning rotor, drive means for drivingly moving said cleaning element means to execute rotor cleaning motions, and spring member means interconnecting said cleaning element means and said drive means while permitting adjusting movement of said cleaning element means in a direction radial to the rotor rotational axis of a spinning rotor being cleaned, wherein the spring member means includes unilaterally held spiral springs disposed in a plane extending radially to the rotational axis of the rotary drive, and wherein the cleaning elements are disposed on said unilaterally held spiral springs.

* * * * *